US008128340B2

(12) United States Patent
Racer et al.

(10) Patent No.: US 8,128,340 B2
(45) Date of Patent: Mar. 6, 2012

(54) STACKED SELF-PRIMING PUMP AND CENTRIFUGAL PUMP

(75) Inventors: Donald W. Racer, Shelby, OH (US); Michael L. Keith, Mansfield, OH (US)

(73) Assignee: Gorman-Rupp, Co., Mansfield, OH (US)

( * ) Notice: Subject to any disclaimer, the term of this patent is extended or adjusted under 35 U.S.C. 154(b) by 195 days.

(21) Appl. No.: 10/794,400

(22) Filed: Mar. 8, 2004

(65) Prior Publication Data

US 2005/0196269 A1 Sep. 8, 2005

(51) Int. Cl.
*F04D 9/02* (2006.01)
*F04D 1/06* (2006.01)
*F04D 29/62* (2006.01)

(52) U.S. Cl. ..... 415/56.1; 415/61; 415/62; 415/66; 415/122.1; 415/123; 415/124.2; 415/174.1; 415/174.4; 415/126; 415/201; 415/912; 417/199.2; 417/244; 417/362

(58) Field of Classification Search ..... 415/56.1, 415/56.3, 56.4, 56.5, 56.6, 60–62, 66, 122.1, 415/123, 124.2, 126, 128, 174.1, 174.4, 196, 415/201, 912; 417/199.2, 200, 244, 362
See application file for complete search history.

(56) References Cited

U.S. PATENT DOCUMENTS

| | | | | |
|---|---|---|---|---|
| 466,805 | A * | 1/1892 | Spang | 415/66 |
| 706,187 | A * | 8/1902 | Lindmark | 415/66 |
| 717,877 | A * | 1/1903 | Lindmark | 415/66 |
| 1,069,408 | A * | 8/1913 | Gaede | 415/66 |
| 2,037,775 | A * | 4/1936 | Fox | 415/61 |
| 2,175,997 | A | 9/1937 | Saxe | |
| 2,736,489 | A * | 2/1956 | Bopf | 415/201 |
| 3,279,386 | A | 10/1966 | Rupp et al. | |
| 3,387,769 | A * | 6/1968 | Davis | 415/62 |
| 3,936,240 | A | 2/1976 | Dochterman | |
| 4,278,399 | A | 7/1981 | Erickson | |
| 4,395,130 | A | 7/1983 | Kutowy | |
| 4,586,468 | A | 5/1986 | Dzioba | |
| 5,160,240 | A | 11/1992 | Wilson | |
| 5,201,633 | A | 4/1993 | Peu | |
| 5,213,491 | A | 5/1993 | Fujiwara et al. | |
| 5,215,448 | A | 6/1993 | Cooper | |
| 5,340,272 | A | 8/1994 | Fehlau | |

(Continued)

FOREIGN PATENT DOCUMENTS

DE 2824523 A1 12/1979

(Continued)

OTHER PUBLICATIONS

"T Series: Self-Priming Centrifugal Pumps." The Gorman-Rupp Company, 1999, pp. 12.

(Continued)

*Primary Examiner* — Christopher Verdier
(74) *Attorney, Agent, or Firm* — McDermott Will & Emery LLP

(57) ABSTRACT

A stacked pump arrangement for mixed-media flow includes a first, self-priming, centrifugal pump with a volute having an inlet and an outlet and a second straight centrifugal pump mounted to an upper portion of the first centrifugal pump, the second straight centrifugal pump also having a volute with an inlet and an outlet. A transition chamber is connected, at one end, to the first centrifugal pump volute outlet and is connected, at another end, to the second straight centrifugal pump volute inlet.

33 Claims, 9 Drawing Sheets

U.S. PATENT DOCUMENTS

| | | | |
|---|---|---|---|
| 5,660,520 | A | 8/1997 | Scarsdale |
| 5,829,958 | A | 11/1998 | Von Hollen |
| 6,068,444 | A | 5/2000 | Sheth |
| 6,227,802 | B1 | 5/2001 | Torgerson et al. |
| 2003/0192621 | A1 | 10/2003 | Allora |

FOREIGN PATENT DOCUMENTS

| | | | | | |
|---|---|---|---|---|---|
| DE | 2824523 | A1 | * | 12/1979 | ..... 415/66 |
| DE | 115 431 | C | | 9/1999 | |
| DE | 103 31 578 | A1 | | 2/2005 | |
| FR | 2 678 987 | A | | 1/1993 | |
| SU | 1041753 | A | * | 9/1983 | ..... 415/66 |
| WO | WO 02/25117 | A1 | | 3/2002 | |

OTHER PUBLICATIONS

New Zealand Examination Report issued in New Zealand Patent Application No. 549858 dated Mar. 9, 2009.

Chinese Office Action Issued in Chinese Patent Application No. CN 2005-800141297 dated on May 9, 2008.

United States Office Action issued in U.S. Appl. No. 10/592,145 dated Mar. 29, 2011.

* cited by examiner

SECTION A-A

STACKED SELF-PRIMING PUMP AND CENTRIFUGAL PUMP

TECHNICAL FIELD

The technical field relates to pumps, and, more particularly to pumps used to pump mixtures of solids and liquids, solids-laden mixtures, and slurries.

BACKGROUND

Centrifugal pumps use centrifugal force to move liquids from a lower pressure to a higher pressure and employ an impeller, typically comprising of a connecting hub with a number of vanes and shrouds, rotating in a volute or casing. Liquid drawn into the center of the impeller is accelerated outwardly by the rotating impeller vanes toward the periphery of the casing, where it is then discharged at a higher pressure.

Centrifugal pumps, such as trash pumps, are conventionally used in applications involving mixtures of solids and liquids, solids-laden mixtures, slurries, sludge, raw unscreened sewage, miscellaneous liquids and contaminated trashy fluids, collectively referred to as mixed-media flow or mixed-media fluids. These mixed-media fluids are encountered in applications including, but not limited to, sewage plants, sewage handling applications, paper mills, reduction plants, steel mills, food processing plants, automotive factories, tanneries, and wineries.

As one example, such pumps are used in sewage lift stations to move wastewater to a wastewater treatment plant. In some aspects, submersible pumps are disposed in a wet well below ground (e.g., 20' below ground) and are configured to lift the wastewater to an elevation just below ground level, where it is passed to downwardly sloping conduits that utilize gravity to move the flow along the conduit to the next lift station. This operation is repeated at subsequent lift stations to move the wastewater to a wastewater treatment plant. Another form of lift station utilizes "dry well" pumps, wherein one or more self-priming centrifugal pumps and associated controls and drivers (i.e., motor or engine) are either located in a (dry) building above ground or in a (dry) fiberglass (or concrete, metal, and/or polymer) room disposed below ground. Above-ground configurations utilize a self-priming centrifugal pump and an intake extending down into a wet well holding the influent wastewater. An exemplary solids-handling self-priming centrifugal pump for such application includes the Gorman Rupp T-Series™ or Super T-Series™ pumps, which feature a large volute design allowing automatic re-priming in a completely open system without the need for suction or discharge check valves and with a partially liquid-filled pump casing and a dry suction line. Depending on the size and configuration, these pumps generally handle a maximum solids diameter of between about 1.5"-3" with a maximum head of between about 110 ft.-150 ft. Below-ground configurations typically use either a non-self-priming centrifugal pump disposed beneath the wet well, so as to provide a flooded pump suction, or use a self-priming pump. Flooded non-self-priming pumps correspondingly require an isolation means (e.g., a valve) to permit isolation of the pump suction to allow for pump cleaning and maintenance.

Controls in either the wet well or dry well monitor the wet well level and turn on one or more pumps as necessary to maintain a desired wet well state. The operation of the lift stations are often remotely monitored by means such as SCADA (Supervisory Control and Data Acquisition) systems or local node boxes at the lift station which transmit information to a base station or intermediary (e.g., Internet) at selected intervals via a hard-wired land line or transmission, such as microwave or RF signal.

The nature of the conveyed medium poses significant challenges to continuous operation of the pumps. One potential problem in such applications is the clogging of the impeller or pump by debris in the pumped medium. Therefore, pump serviceability is an important factor. Conventional multi-stage pumps comprise a plurality of sequential stages arranged so that the discharge portion of one stage feeds liquid into the inlet portion of the next stage and each impeller is driven by a common impeller drive shaft. Rotation of the impeller drive shaft turns each impeller to force fluid outwardly into an internal passage which directs the fluid to the subsequent adjacent pump stage. However, these internal passages are difficult to clean and the pump must be substantially dismantled to permit cleaning. Predictably, these multi-stage pumps are used in applications where fouling or clogging is not of concern, such as well or water pumps, and these pumps are not conducive to use in mixed-media flow.

Additional improvements in pump characteristics, such as discharge head, would be advantageous in many applications. For example, in the above-noted sewage handling application, lift stations are expensive to build, with a cost that typically ranges between about forty five thousand dollars and several hundred thousand dollars and may even exceed a million dollars in some instances. A higher head solids-handling self-priming centrifugal pump could be used to reduce the number of lift stations required to transmit wastewater to a wastewater treatment facility. Use of larger, higher-head trash pumps is possible, but such large pumps would have to operate at speeds higher than is generally advisable for a trash-type impeller, particularly in view of the fact that sewage pumps are expected to provide efficient operation for long periods of time without the need for frequent maintenance. Addition of pumps in series with existing pumps in a conventional manner is cumbersome or highly impractical given the space constraints imposed by the limited space available in conventional lift stations and would be a costly proposition when the additional space requirements are factored into the designs of new, more expansive facilities.

SUMMARY

Accordingly, there is a need for an improved multi-pump configuration for pumping mixtures of solids and liquids, solids-laden mixtures, and slurries. There is also a need for an improved pump configuration providing increases in pump performance while simultaneously maintaining a compact configuration (e.g., without increasing the footprint of the pump).

In one aspect, a stacked pump arrangement for mixed-media flow includes a first, self-priming, centrifugal pump with a volute having an inlet and an outlet and a second straight centrifugal pump mounted to an upper portion of the first centrifugal pump, the second straight centrifugal pump also having a volute with an inlet and an outlet. A transition chamber is connected, at one end, to the first centrifugal pump volute outlet and is connected, at another end, to the second straight centrifugal pump volute inlet.

In another aspect, a pump arrangement is provided comprising a first self-priming centrifugal pump, comprising a volute having an inlet and an outlet, and a first rotating assembly comprising an impeller shaft and impeller and a second straight centrifugal pump mounted externally to an upper portion of the first centrifugal pump, the second straight centrifugal pump comprising a volute with an inlet and an outlet, a second rotating assembly comprising an impeller shaft and impeller. This arrangement also includes a transition chamber connected, at one end, to the first centrifugal pump volute outlet and connected, at another end, to the second straight centrifugal pump volute inlet. In various other aspects thereof, the first centrifugal pump impeller shaft is aligned with the second straight centrifugal pump impeller shaft along a longitudinal axis and/or a vertical axis and the rotating assemblies may be driven by separate power sources or by a common power source.

In yet another aspect, a pump arrangement is provided comprising a first self-priming centrifugal pump comprising a volute having an inlet and an outlet, and a first rotating assembly comprising an impeller shaft and impeller and a second straight centrifugal pump mounted externally to an upper portion of the first centrifugal pump, the second centrifugal pump comprising a volute with an inlet and an outlet, a second rotating assembly comprising an impeller shaft and impeller. A transition chamber serving as both a structural support for the second centrifugal pump and a flow path for mixed media flow between the first centrifugal pump and the second centrifugal pump is connected, at one end, to the first centrifugal pump volute outlet and is connected, at another end, to the second centrifugal pump volute inlet.

Other aspects and advantages of the present disclosure will become apparent to those skilled in this art from the following description of preferred aspects taken in conjunction with the accompanying drawings. As will be realized, the disclosed concepts are capable of other and different embodiments, and its details are capable of modifications in various obvious respects, all without departing from the spirit thereof. Accordingly, the drawings, disclosed aspects, and description are to be regarded as illustrative in nature, and not as restrictive.

DETAILED DESCRIPTION

Figure 1:
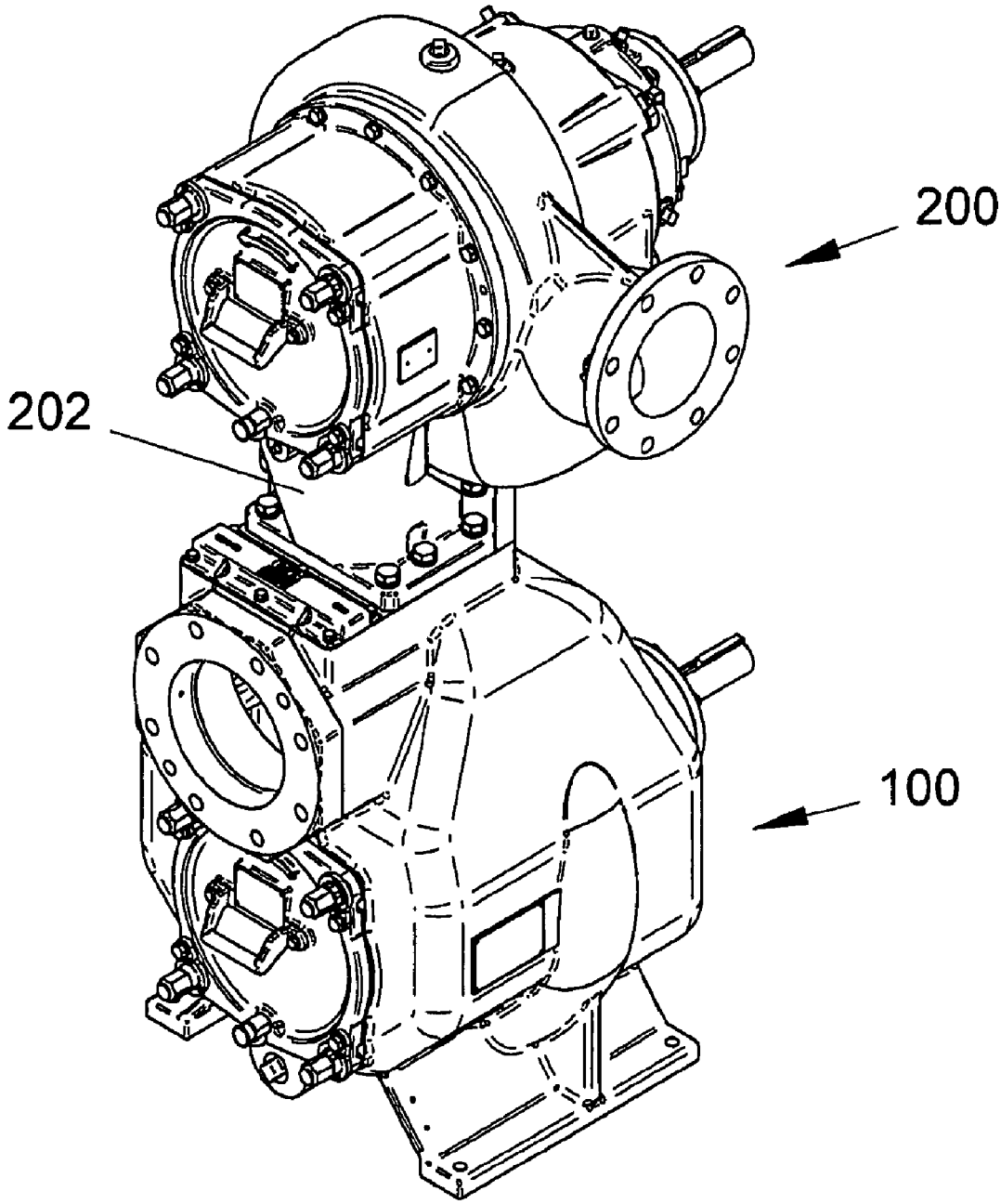
FIG. 1 is an isometric view of an example of a pump arrangement in accord with the present concepts.

FIG. 1 shows an example of a stacked pump arrangement in accord with the present concepts comprising a lower self-priming centrifugal pump 100 and an upper centrifugal pump 200. Whereas conventional pumps disposed in series are often laterally displaced from one another and connecting by piping runs, the illustrated stacked pump directly connects the outlet 105 of the lower self-priming centrifugal pump 100, shown in FIG. 2, to the inlet of upper centrifugal pump 200 by means of transition chamber 202. The transition chamber 202 eliminates complicated plumbing (e.g., multiple pipes, flanges, elbows, and fittings) and long piping runs that would otherwise be required to connect the pumps in lieu of a simplified, space-minimized connection scheme. Transition chamber 202 connects and transitions flow from the discharge of the lower self-priming centrifugal pump 100 to the suction of the upper centrifugal pump 200, which is a straight centrifugal pump in one embodiment. Although FIG. 1 shows the upper centrifugal pump 200 as being disposed directly above and in vertical alignment relative to the lower self-priming centrifugal pump 100, the upper centrifugal pump may be offset from the lower self-priming centrifugal pump along one or more axes. For example, the upper centrifugal pump may be offset, i.e., cantilevered, at some angle (e.g., 15, ° 30° or 45°) from the vertical center-line of the lower self-priming centrifugal pump or may be offset longitudinally (i.e., front-to-back) with respect to the lower self-priming centrifugal pump. In such configurations, the transition chamber 202 would be reconfigured to directly connect the outlet 105 of the lower self-priming centrifugal pump 100 to the suction of the upper centrifugal pump 200.

Figure 2:
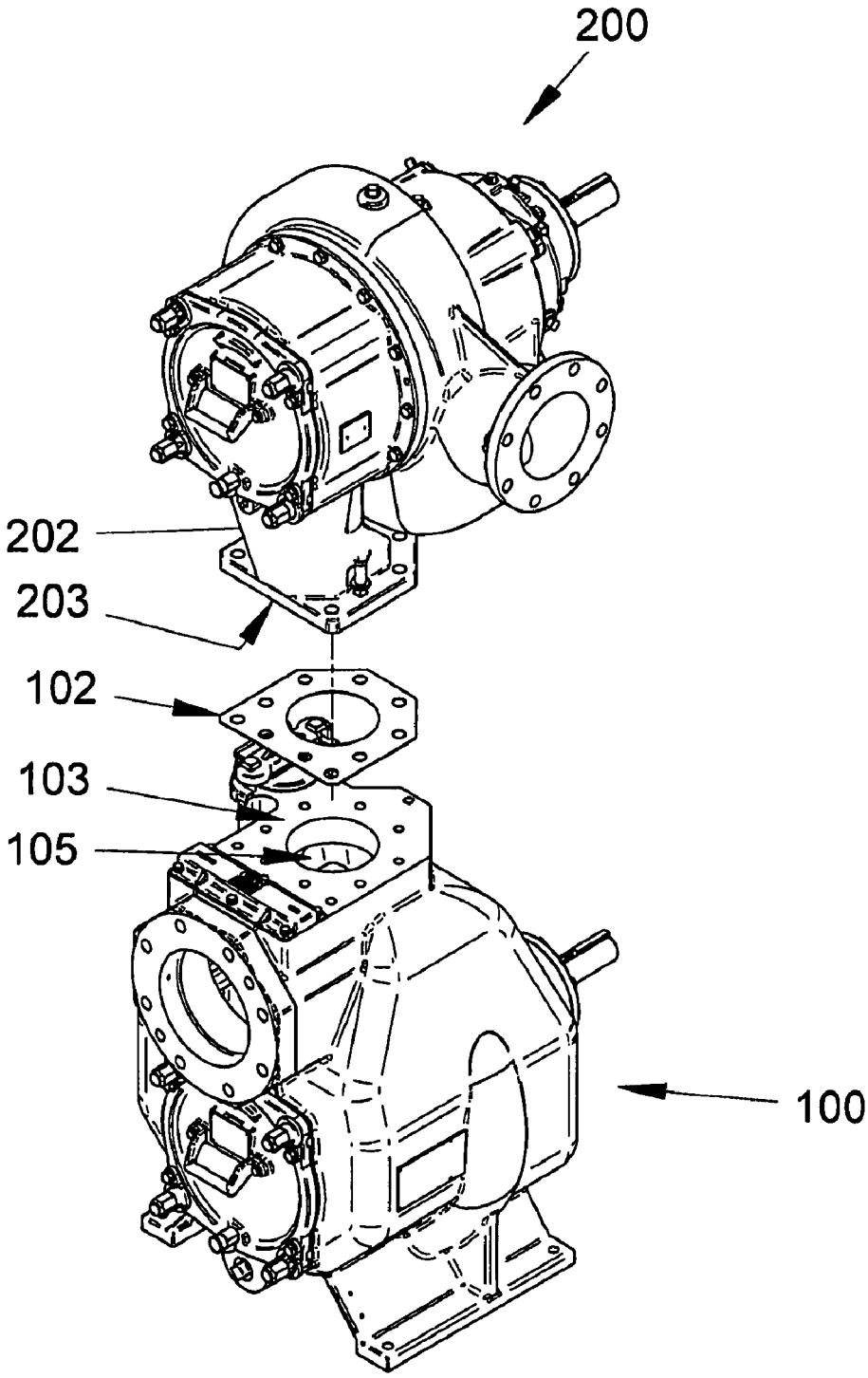
FIG. 2 is an isometric, partially-exploded view of the pump arrangement shown in FIG. 1.

FIG. 2 shows an example of a connection between straight centrifugal pump 200 to the self-priming centrifugal pump 100 by a flange 203 provided on an underside of transition chamber 202 and a corresponding flange 103 disposed on an upper side of the lower-self priming centrifugal pump 100 using gasket 102. This stacked pump arrangement provides a higher discharge head while maintaining the footprint of a single pump. Accordingly, this stacked pump arrangement does not require as much floor space as the side-by-side series pumping arrangements and, correspondingly, does not require expansion or modification of existing facilities or design of new facilities to accommodate the increased space requirements of conventional series pump arrangements. The stacked pump arrangement also avoids the need for substitution of a single, larger pump, which would not operate as efficiently as the stacked pump arrangement disclosed herein.

Figure 3:
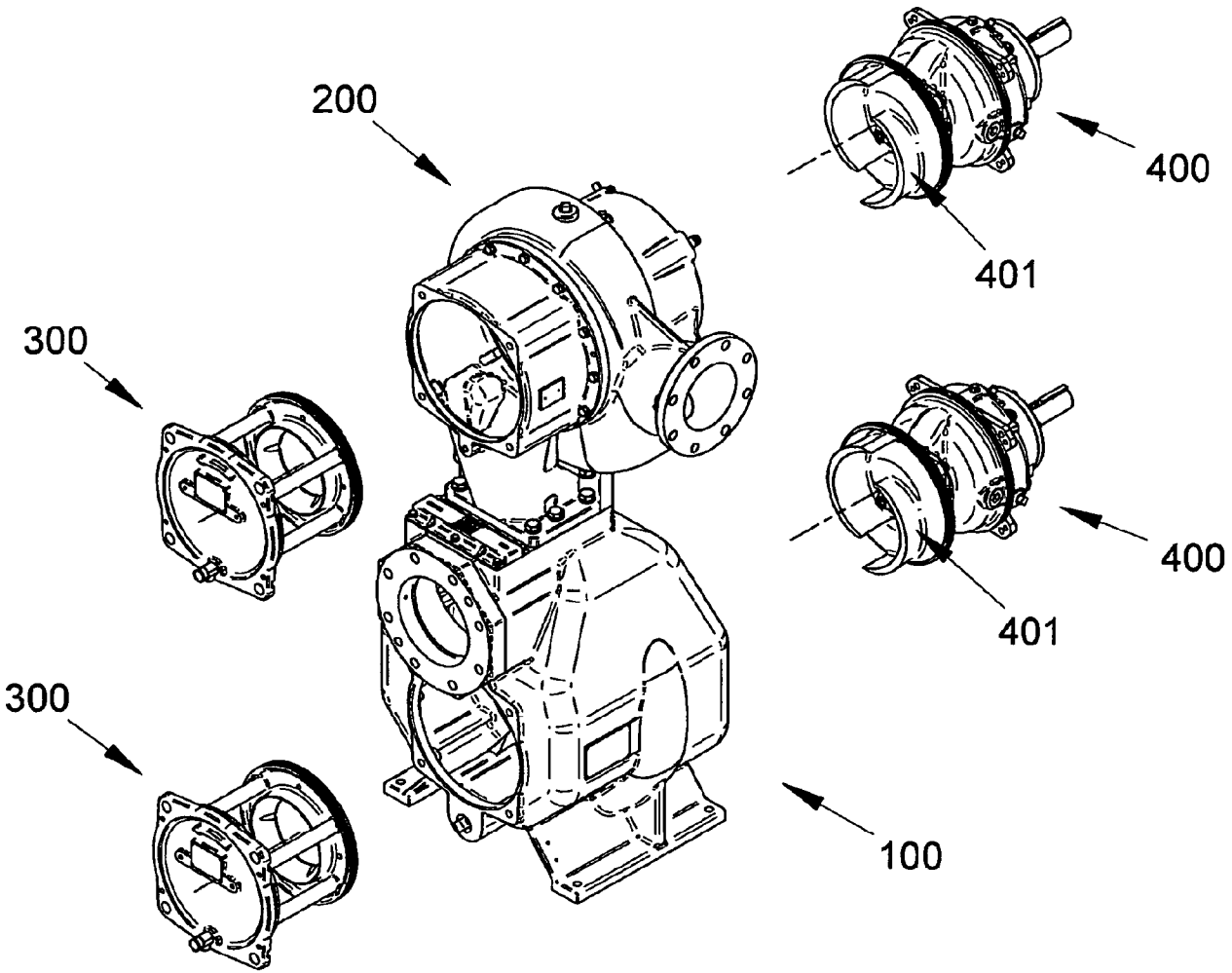
FIG. 3 is another isometric, partially-exploded view of the pump arrangement shown in FIG. 1.

FIG. 3 is another isometric, partially-exploded view of the stacked pump arrangement shown in FIGS. 1-2. FIG. 3 shows the removable cover and wear plate assembly 300 and the removable rotating assemblies 400 that are common to each of the centrifugal pumps 100, 200, in the illustrated example. In one embodiment, removable cover and wear plate assembly 300 for centrifugal pump 100 is substantially identical to removable cover and wear plate assembly 300 for centrifugal pump 200. Similarly, removable rotating assembly 400 for centrifugal pump 100 is substantially identical to removable rotating assembly 400 for centrifugal pump 200. Removable cover and wear plate assembly 300 may be removed following the removal of a few retaining screws, thereby providing quick and easy access to the pump interior without the need to disconnect any piping and without the need for special tools. This configuration permits clogs in the pumps 100, 200 to be removed and the pump returned to service within several minutes. The impeller, seal, wear plate, and flap valve (discussed later) can also be accessed through the cover plate opening for inspection or service. The removable rotating assemblies 400 are configured to be easily slid out when the retaining bolts (not shown) are removed on the backside of the pump to permit inspection of the pump shaft or bearings without disturbing the pump casing or piping. Although the present concepts advantageously utilize one or more interchangeable parts or assemblies, such as shown in FIG. 3, the concepts expressed herein include centrifugal pumps 100, 200 having different covers, wear plates, and/or rotating assemblies.

Figure 4:
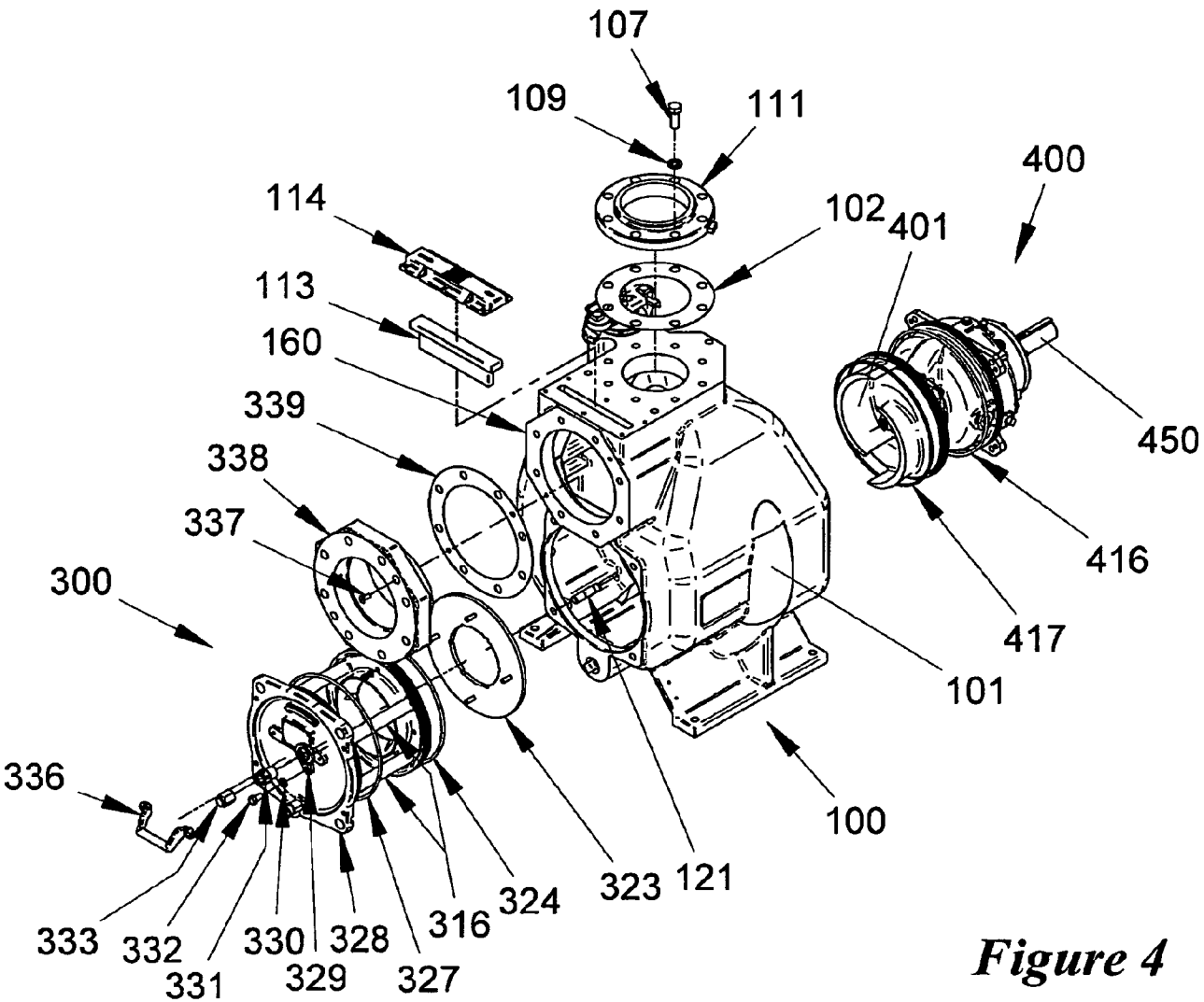
FIG. 4 is an isometric, exploded view of the lower pump in the pump arrangement shown in FIG. 1.

FIG. 4 is an isometric, exploded view of the lower pump in the stacked pump arrangement shown in FIG. 1. Certain features from the Gorman-Rupp Company Super T-series™ of self-priming centrifugal pumps are present in the pump of FIG. 4. For example, rotating assemblies 400 are, in the illustrated example, manufactured by the Gorman-Rupp Company of Mansfield, Ohio. The impeller 401 and the wear plate 323 may each comprise any conventional metal, alloy, polymer or composite suitably durable for an intended application and duty life. The impeller 401 and/or the wear plate 323 may also include hardened surfaces or added layers of hardened materials facing the opposing one of the impeller or wear plate.

In some aspects, impeller 401 may comprise gray iron, ductile iron, hard iron, CF8M stainless-steel, or CD4MCu. In one aspect, the impeller 401 may comprise an impeller such as described in the patent application titled "Improved Impeller and Wear Plate", assigned to the Gorman-Rupp Company, and filed on Oct. 31, 2003 as U.S. patent application Ser. No. 10/697,162, issued as U.S. Pat. No. 7,037,069, and which is hereby incorporated by reference in its entirety. The rotating assembly 400 is attached to a corresponding surface of the centrifugal pump 100 casing or housing 101 using one or more mechanical fasteners, such as a plurality of bolts or screws. O-rings 417, 416 are provided to both seal the connection between the rotating assembly 400 and such corresponding surface of the centrifugal pump casing 101, as well as to facilitate external clearance adjustments.

The removable cover and wear plate assembly 300, which is also offered by the Gorman-Rupp Company, is shown to include a cover plate 328 having a handle 336, locking collar 329, adjustment screw 331, hand nut 333, and hex head capscrew 332. The removable cover and wear plate assembly 300 is described in the patent application titled "Centrifugal Pump Having Adjustable Cleanout Assembly", assigned to the Gorman-Rupp Company, and filed on Sep. 16, 2002 as U.S. patent application Ser. No. 10/221,825, issued as U.S. Pat. No. 6,887,034, and which is hereby incorporated by reference in its entirety. In one aspect, shown in FIG. 4, the removable cover and wear plate assembly 300 is positioned within the centrifugal pump 100 using one or more studs 121. Cover plate 328 is preferably shim-less to permit easy adjustment and eliminate the need to realign belts, couplings, or other drive components without disturbing the working height of the seal assembly or the impeller back clearance. O-rings 324, 327 are respectively provided to seal the cover plate 328 against the corresponding surfaces of the centrifugal pump 100 casing and to seal the connection between the backside of the cover plate assembly and wear plate 323.

Connecting members 316 are provided to dispose the wear plate 323 at a predetermined location within the volute. In the illustrated example, the connecting members 316 are solid ribs and the position of the wear plate 323 may be adjusted by adjusting a position of the cover plate 328 relative to the centrifugal pump 100 casing. In other aspects, however, connecting members 316 may be adjustable to permit positioning adjustment by variation of an adjustable length of the connecting members. A suction flange 338 and suction gasket 339 are connected to the volute 101 by mechanical fasteners, such as a plurality of bolts or screws 337, to provide a suction inlet. Alternately, other conventional universal sealing arrangements may be provided in place of the removable cover and wear plate assembly 300.

A flap valve or check valve 113 is optionally disposed on an inside of the suction inlet and affixed at an upper end to the centrifugal pump casing 101 by a flap valve cover 114. Flap valve cover 114 is preferably attached with mechanical fasteners that permit the flap valve 113 to be accessed without the need for special tools.

In one aspect, shown in FIG. 4, a discharge adapter plate 111 is disposed over a discharge gasket 102 at an upper side of the centrifugal pump casing 101 and connected thereto by conventional mechanical fasteners such as, but not limited to, a plurality of studs 107, hex nuts 108, and lock washers 109. In this configuration, the self-priming centrifugal pump 100 may be provided separately from the upper straight centrifugal pump as a stand-alone unit having a discharge connected directly to an outlet piping run. This modularity permits a municipality, facility, or purchaser to purchase a first pump as a stand-alone unit to match existing capacity needs and/or budgets while maintaining the option of adding the second straight centrifugal pump 200 at a later time. If modularity is not an issue, the discharge adapter plate 111 and associated components may be eliminated and the transition chamber 202 flange 203 is directly connected to the corresponding flange 103 disposed on an upper side of the lower-self priming centrifugal pump 100 using gasket 102, as shown in FIGS. 1-3.

Figure 5:
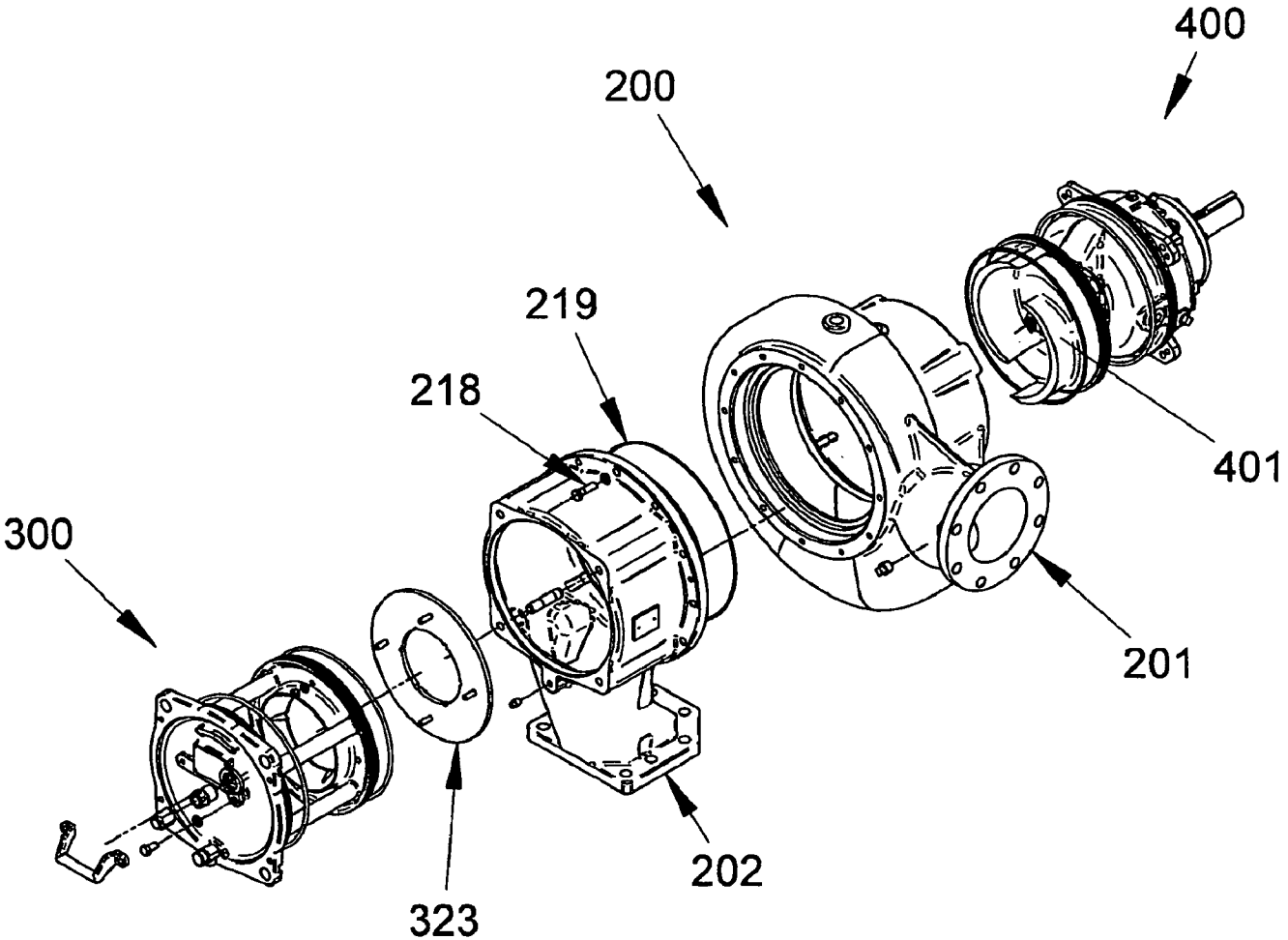
FIG. 5 is an isometric, exploded view of the upper pump in the pump arrangement shown in FIG. 1.

FIG. 5 is an isometric, exploded view of the upper pump in the stacked pump arrangement shown in FIG. 1. As previously noted, this pump advantageously uses the same removable cover and wear plate assembly 300 and removable rotating assembly 400 that is used in the lower self-priming centrifugal pump 100 shown in FIG. 4 and a discussion thereof is accordingly omitted. Significantly, the volute of centrifugal pump 200 comprises a separate volute 201 and transition chamber or transition piece 202, which are connected by a plurality of mechanical fasteners, such as bolts 218, circumferentially arranged about the volute 201 intake opening 225. An O-ring 219, such as a nitrile O-ring, is provided for sealing. Owing to the two-part structure, the volute 201 is rotatable prior to connection to the transition chamber 202. Accordingly, the centrifugal pump 200 outlet 250 may be oriented to the right as shown in FIG. 6, vertically, to the left (i.e. a rotation of 180° from the orientation shown), below the horizontal, or any of a plurality of positions therebetween.

Figure 6:
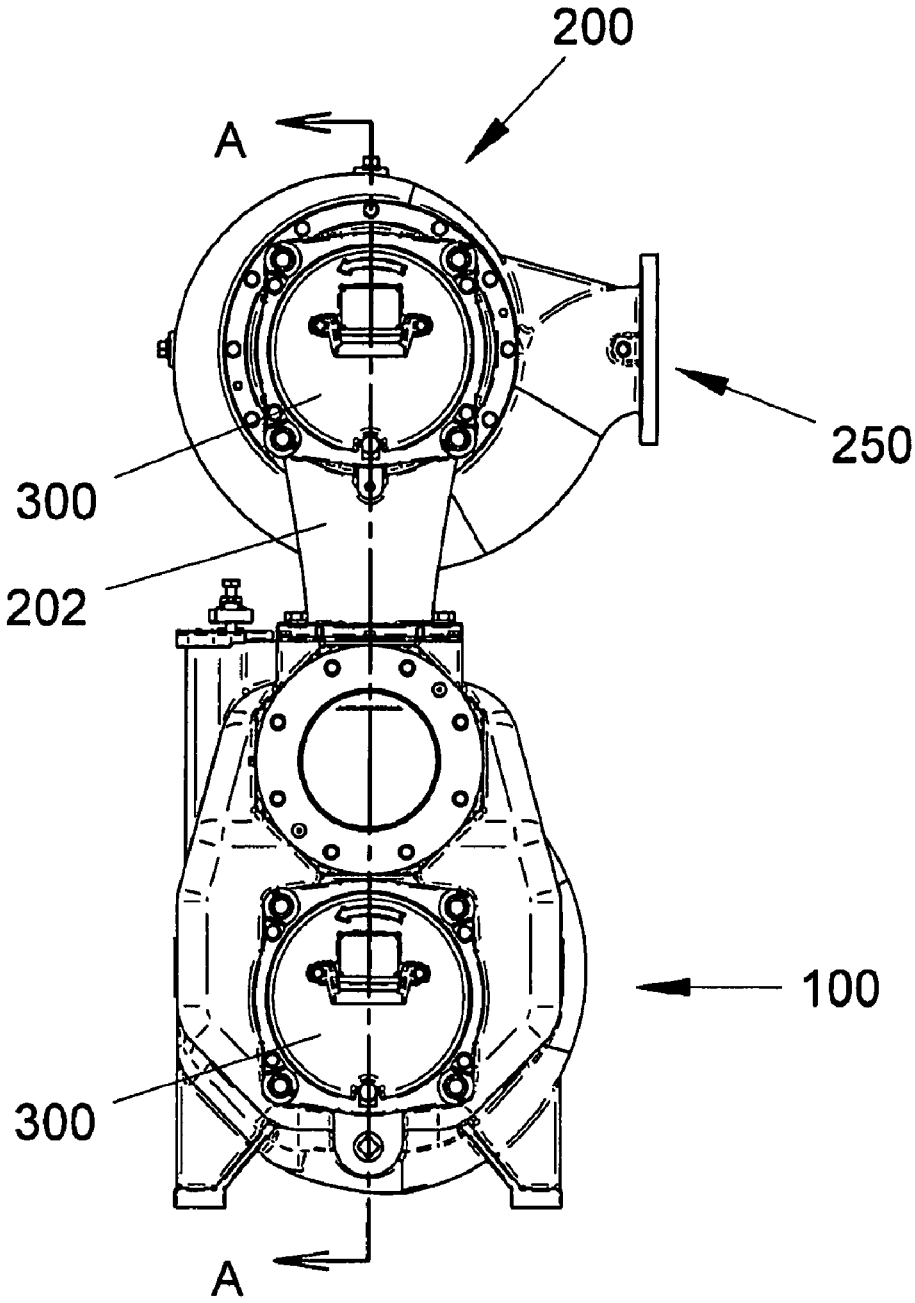
FIG. 6 is a front view of the pump arrangement shown in FIG. 1.

As shown in FIG. 6, the width of transition chamber 202 increases with height. In the aspect shown, the increase in width is substantially linear with an increase in height. Internally, the transition chamber 202 is configured, at a minimum, to correspond to the internal clearances of the self-priming centrifugal pump 100. Since the disclosed pump arrangement is intended for use with mixtures of solids and liquids, solids-laden mixtures, slurries, sludge, raw unscreened sewage, miscellaneous liquids and contaminated trashy fluids, the transition chamber 202 cross-sectional area and internal dimensions must be sized to permit passage of solids output by the self-priming centrifugal pump 100. For example, a 2" pump is designed to pass a solid size of 1.75" (a "solid design diameter"), a 3" self-priming centrifugal pump 100 is designed to pass a solid having a 2.5" diameter, and larger self-priming centrifugal pumps (e.g., 4", 6", 8", 10", or 12" or larger) are designed to pass a solid having a 3" diameter. Thus, save for this constraint, the geometry of the transition chamber 202 is variable. The present concepts expressed herein are not limited to these configurations and, instead, include pumps of the same size and/or different sizes configured to solids of the same and/or different sizes than those indicated (e.g., a 6" pump configured to pass a 4" diameter solid). As noted above, it is sufficient that the transition chamber 202 minimum cross-sectional area corresponds at least to a minimum cross-sectional area of the self-priming centrifugal pump 100 solid design diameter. Stated differently, the transition chamber 202 flow pathway has a cross-sectional area and minimal transverse dimensions sufficient to enable passage of an object equal or substantially equal to or greater than a solid which may be output by the first pump in accord with a solid design diameter of the first pump.

Figure 7:
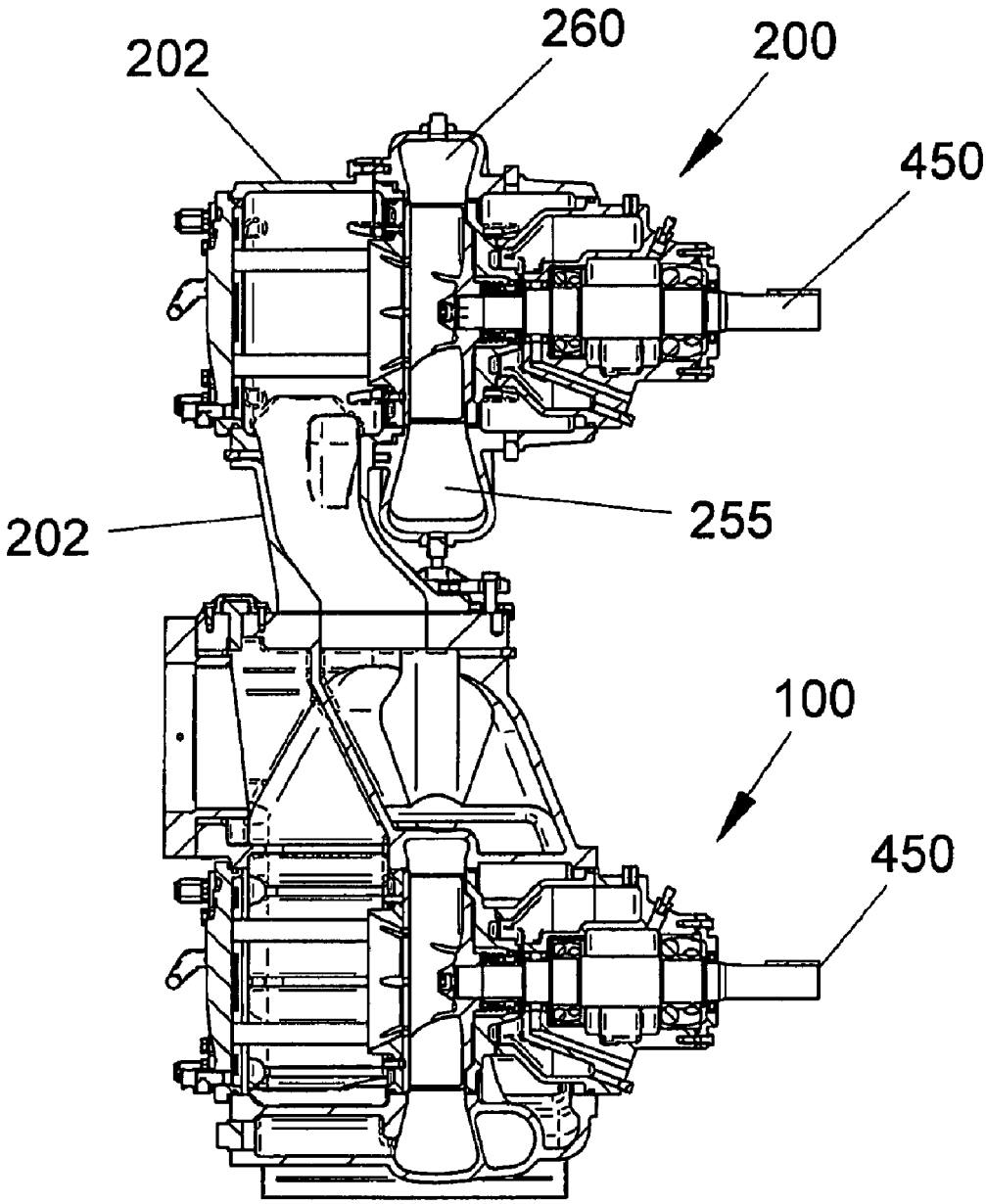
FIG. 7 is a cross-sectional view of the pump arrangement shown of FIG. 4, taken along the cross-section A-A.

In the example shown in the cross-sectional view of FIG. 7, a base portion of the transition chamber 202 is forwardly biased or curved. Since the illustrated example is configured to permit rotation of the volute 201 relative to the transition chamber 202 prior to securement, the transition chamber is correspondingly configured to permit sufficient clearance for both the large diameter section 255 and the small diameter section 260 of the volute. In this stacked configuration, the driven end of the impeller shafts 450 in the upper and lower rotating assemblies 400 are longitudinally aligned (see FIG. 7) and vertically aligned (see FIG. 6). Alignment of the impeller shafts 450 in this manner permits a simpler coupling of the impeller shafts to a common drive source. However, alignment of the impeller shafts 450 along the longitudinal axis and/or vertical axis is optional and the impeller shafts may alternatively be longitudinally and/or vertically displaced from one another. This alternative arrangement complicates the power transmission and drive coupling somewhat, but permits greater flexibility in the design of transition chamber 202.

Figure 8A:
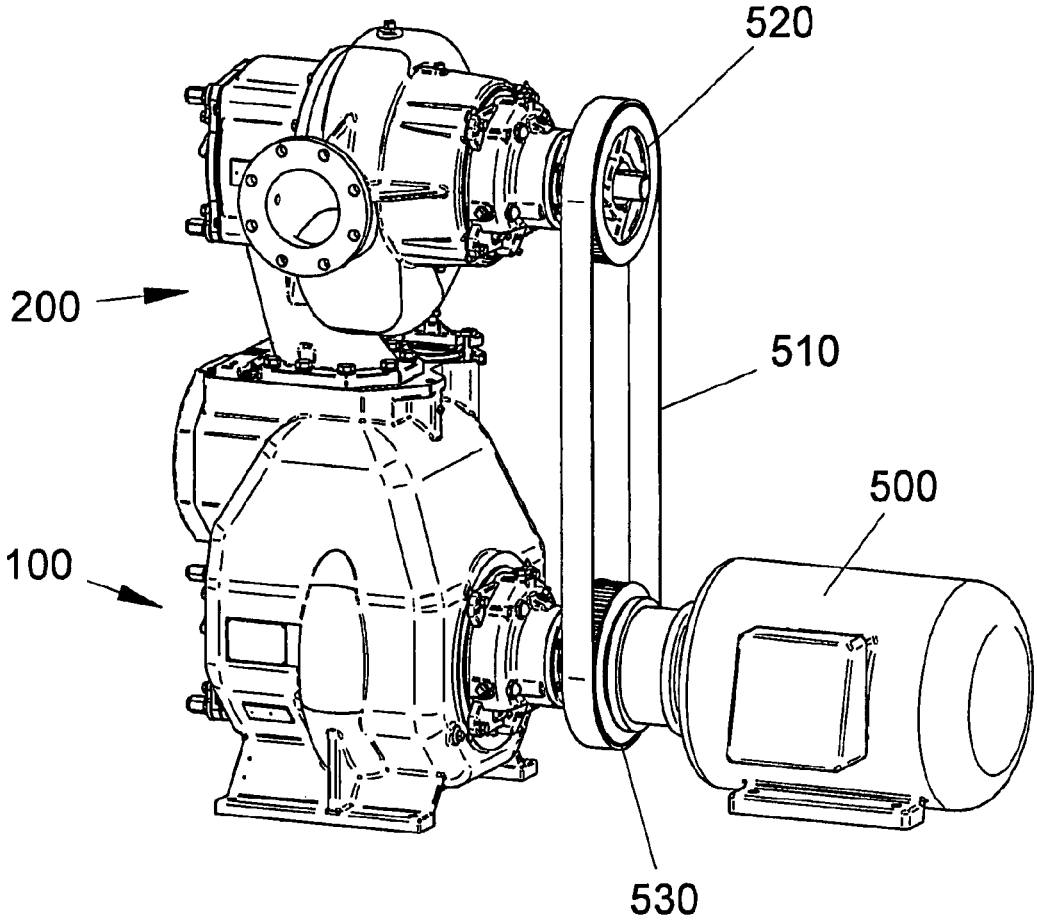
FIGS. 8(*a*)-8(*b*) show examples of a stacked pump arrangement in accord with the present concepts showing a power source and power transmission elements.
Figure 8B:
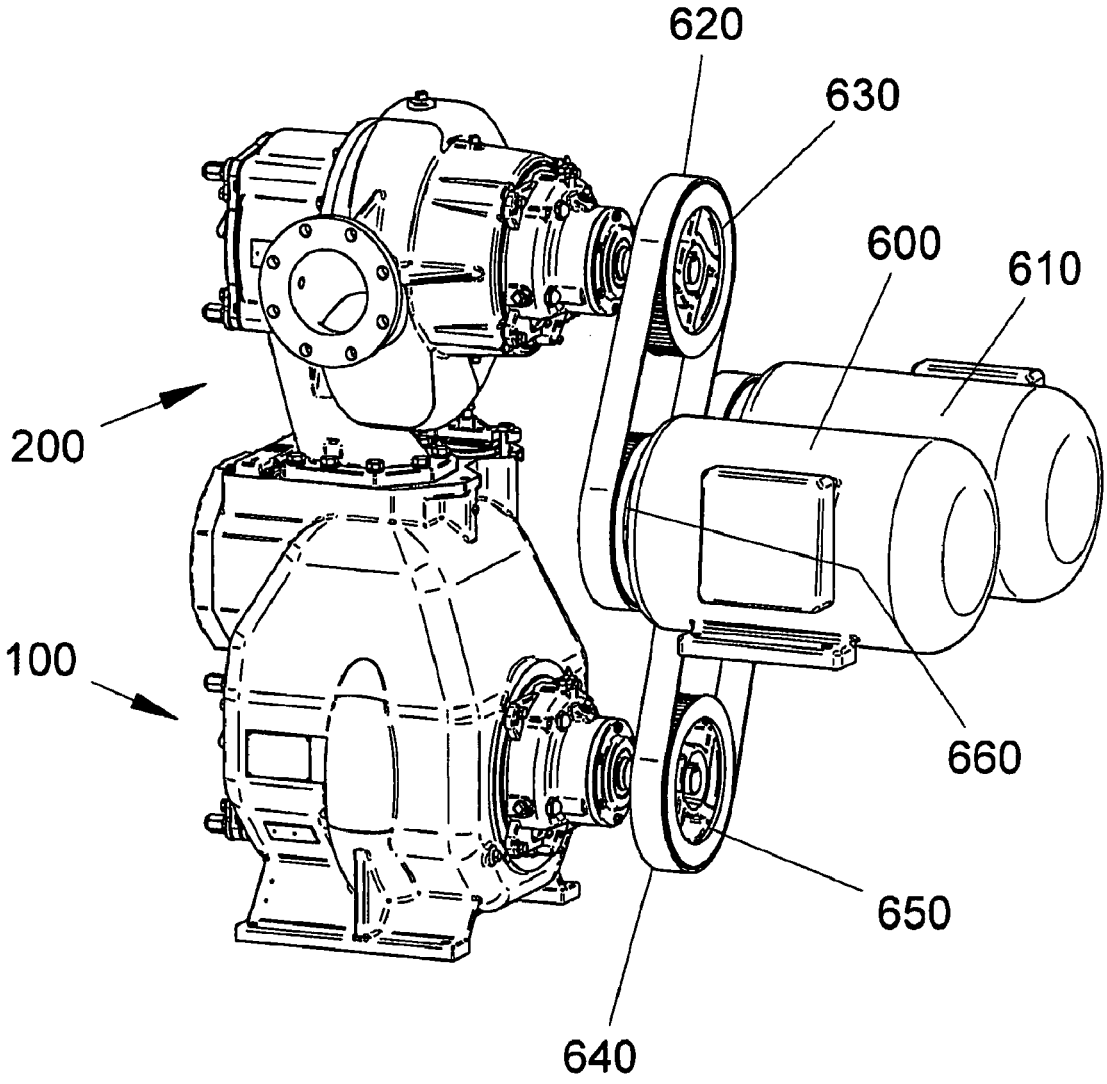

Pumps 100, 200 may be driven by a single electric motor, such as a variable frequency drive (VFD), or other conventional power source (e.g., a fuel-based combustion engine, such as a gas or diesel engine) through an appropriate power transmission device, such as shown in FIG. 8. VFDs are well-suited for wastewater treatment processes as they can adapt quickly to accommodate fluctuating demand and permit a "soft start" capability to reduce mechanical and electrical stress on the motor, with corresponding benefits of reduced maintenance, extended motor life, and reduced operating costs.

Power transmission may be had by a conventional flat belt, V-belt, wedge belt, timing belt, spur gear, bevel gear, helical gear, worm gear, slip clutch, and chain and a correspondingly configured matching pulley, gear, and/or gear set, as applicable, or by any other conventional power transmission member(s). A sheave and V-belt drive system, for example, is employed with the number of sheaves and V-belts selected to accommodate, in a manner known to those of ordinary skill in the art, the range of torques intended to be transmitted from the power source to the associated drive shaft or impeller shaft.

FIGS. 8(*a*)-8(*b*) depict examples of various belt drive configurations. FIG. 8(*a*) shows a single motor 500 used to directly drive the impeller shaft (not shown) of the lower self-priming centrifugal pump 100 and to simultaneously drive the upper straight centrifugal pump 200 by means of a belt 510 disposed around a corresponding sheave 520 on one end and disposed on sheave 530 on another end. FIG. 8(*b*) shows a dual motor configuration wherein each motor 600, 610 separately drives a driven end of an associated impeller shaft by means of individual belts 620, 640 disposed around, on one side, a sheave (e.g., 660) disposed on the motor output shaft and around, on the other side, a sheave 630, 650 disposed on a driven end of the impeller shaft. Thus, each rotating assembly 400 may be separately powered by any type of conventional electric motor or fuel-based combustion engine. For example, one pump (e.g., 100) could be driven by a VFD at one selected speed (e.g., 1750 rpm) different from that of a VFD used to drive the other pump (e.g., 200, driven at 1450 rpm) at a selected operation point.

As compared to a conventional Gorman-Rupp Company Super T-Series™ self-priming centrifugal pump which provides, for a pump speed of about 1550 rpm, a TDH (Total Dynamic Head) of about 120 ft. at zero flow which slowly decreases to about 100 ft. TDH at 700 gpm and about 70 ft. TDH at 1400 gpm. The stacked pump arrangement in accord with the present concepts produces, at a pump speed of about 1950 rpm, a TDH of about 400 ft. at zero flow which decreases to about 335 ft. TDH at 700 gpm and about 270 ft. TDH at 1400 gpm. These figures represent preliminary test data and are intended to be illustrative in nature and are not intended to necessarily represent production operational characteristics.

In accord with the present disclosure, this stacked pump arrangement provides a higher discharge head while maintaining the footprint of a single pump and as well as the simplicity of serviceability offered by conventional Gorman-Rupp pumps. Inasmuch as the present invention is subject to many variations, modifications and changes in detail, it is intended that all subject matter described above or shown in the accompanying drawings be interpreted as merely illustrative in nature.

What is claimed:

1. A stacked pump arrangement for mixed-media flow comprising:

a first centrifugal pump adapted to pump a far mixed-media flow, which is self-priming, comprising a first impeller shaft and a volute having an inlet and an outlet; and a second straight centrifugal pump adapted to pump the mixed-media flow mounted to an upper portion of the first centrifugal pump, the second straight centrifugal pump comprising a volute with an inlet and an outlet, and a second impeller shaft; and a transition chamber connected, at one end, to the first centrifugal pump volute outlet and connected, at another end, to the second straight centrifugal pump volute inlet, the transition chamber serving as a structural support for mounting the second straight centrifugal pump above and in vertical relation to the first centrifugal pump such that a portion of the weight of the second straight centrifugal pump is transferred to the first centrifugal pump, wherein a vertical center axis of the transition chamber is perpendicular to the first and second impeller shafts, and wherein the first and second impeller shafts are substantially parallel to each other along their respective longitudinal axes.

2. A stacked pump arrangement in accord with claim 1, wherein the outlet of the first centrifugal pump is provided at a top portion of the first centrifugal pump.

3. A stacked pump arrangement in accord with claim 1, wherein the inlet of the first centrifugal pump is connected by a fluid pathway to a fluid source adapted to contain a mixed-media fluid.

4. A stacked pump arrangement in accord with claim 3, wherein the transition chamber of the second straight centrifugal pump comprises a flow pathway configured to pass a mixed-media fluid output by the first centrifugal pump.

5. A stacked pump arrangement in accord with claim 4, wherein the transition chamber of the second straight centrifugal pump comprises a flow pathway having a cross-sectional area and minimal transverse dimensions that are one of equal to, substantially equal to, and greater than a corresponding solid design diameter of the first centrifugal pump.

6. A stacked pump arrangement in accord with claim 5, wherein a base portion of the transition chamber is forwardly biased to enable alignment of a driven end of an impeller shaft in the first centrifugal pump with a driven end of an impeller shaft in the second straight centrifugal pump along at least a longitudinal axis.

7. A stacked pump arrangement in accord with claim 6, wherein the transition chamber and the second straight centrifugal pump volute are separate components removably attachable to one another by mechanical fasteners, and wherein the forward biasing of the transition chamber provides sufficient clearance between the transition chamber and the second straight centrifugal pump volute to permit rotation of the second straight centrifugal pump volute relative to the transition chamber prior to securement thereof.

8. A stacked pump arrangement in accord with claim 1, wherein the first centrifugal pump comprises a first removable cover and wear plate assembly, and wherein the second straight centrifugal pump comprises a second removable cover and wear plate assembly.

9. A stacked pump arrangement in accord with claim 8, wherein the first removable cover and wear plate assembly is substantially identical to the second removable cover and wear plate assembly.

10. A stacked pump arrangement in accord with claim 1, wherein the first centrifugal pump comprises a first removable rotating assembly, and wherein the second straight centrifugal pump comprises a second removable rotating assembly.

11. A stacked pump arrangement in accord with claim 10, wherein the first removable rotating assembly is substantially identical to the second removable rotating assembly.

12. A stacked pump arrangement in accord with claim 11, wherein the first removable rotating assembly is driven by a first power source, and wherein the second removable rotating assembly is driven by a second power source.

13. A stacked pump arrangement in accord with claim 12, wherein each of the first power source and the second power source is a variable frequency electric motor.

14. A stacked pump arrangement in accord with claim 13, wherein power is transmitted to the impeller shaft of each of the first centrifugal pump and second straight centrifugal pump rotating assemblies by at least one flat belt, V-belt, wedge belt, timing belt, spur gear, bevel gear, helical gear, worm gear, slip clutch, and chain and one of a correspondingly configured pulley, gear, and gear set.

15. A stacked pump arrangement in accord with claim 11, wherein the first removable rotating assembly and the second removable rotating assembly are driven by a common power source.

16. A stacked pump arrangement in accord with claim 15, wherein the common power source comprises a variable frequency electric motor.

17. A stacked pump arrangement in accord with claim 15, wherein power is transmitted to the first and second removable rotating assemblies by a pulley and sheave arrangement.

18. A pump arrangement comprising:

a first centrifugal pump adapted to pump a mixed-media flow, which is self-priming, comprising a volute having an inlet and an outlet, and a first rotating assembly comprising a first impeller shaft and impeller; and a second straight centrifugal pump, adapted to pump the mixed-media flow, mounted externally to an upper portion of the first centrifugal pump, the second straight centrifugal pump comprising a volute with an inlet and an outlet, a second rotating assembly comprising a second impeller shaft and impeller, and a transition chamber connected, at a first end, to the first centrifugal pump volute outlet and connected, at a second end, to the second straight centrifugal pump volute inlet, the transition chamber serving as a structural support for mounting the second straight centrifugal pump above and in vertical relation to the first centrifugal pump such that a portion of the weight of the second straight centrifugal pump is transferred to the first centrifugal pump;

wherein a vertical center axis of the transition chamber is perpendicular to the first and second impeller shafts, and wherein the first and second impeller shafts are substantially parallel to each other along their respective longitudinal axes.

19. A pump arrangement in accord with claim 18, wherein a driven end of the first centrifugal pump impeller shaft is at least one of longitudinally and vertically aligned with a driven end of the second straight centrifugal pump impeller shaft.

20. A pump arrangement in accord with claim 19, wherein the first rotating assembly is substantially identical to the second rotating assembly.

21. A pump arrangement in accord with claim 20, wherein the first rotating assembly is driven by a first power source and the second rotating assembly is driven by a second power source.

22. A pump arrangement in accord with claim 21, wherein each of the first power source and the second power source is a variable frequency electric motor.

23. A pump arrangement in accord with claim 20, wherein the first rotating assembly and the second rotating assembly are driven by a common power source.

24. A pump arrangement in accord with claim 23, wherein the common power source comprises a variable frequency electric motor.

25. A pump arrangement in accord with claim 20, wherein power is transmitted to the impeller shaft of each of the first and second rotating assemblies by a pulley and sheave arrangement.

26. A pump arrangement in accord with claim 25, wherein the transition chamber and the second straight centrifugal pump volute are separate components removably attachable to one another by mechanical fasteners, and wherein the transition chamber may be rotated to one of a plurality of angular positions relative to the second straight centrifugal pump volute prior to securement of the transition chamber to the second straight centrifugal pump volute.

27. A pump arrangement in accord with claim 18, wherein the first centrifugal pump comprises a first removable cover and wear plate assembly and wherein the second straight centrifugal pump comprises a second removable cover and wear plate assembly.

28. A pump arrangement in accord with claim 27, wherein said first and said second removable cover and wear plate assembly are substantially identical.

29. A pump arrangement comprising:

a first centrifugal pump adapted to pump a mixed-media flow, which is self-priming, comprising a volute having an inlet and an outlet, and a first rotating assembly comprising a first impeller shaft and impeller; and a second centrifugal pump adapted to pump the mixed-media flow, which is a straight centrifugal pump, mounted externally to an upper portion of the first centrifugal pump, the second centrifugal pump comprising a volute with an inlet and an outlet, a second rotating assembly comprising a second impeller shaft and impeller, and a transition chamber connected, at a first end, to the first centrifugal pump volute outlet and connected, at a second end, to the second centrifugal pump volute inlet, to provide a flow path for mixed media flow between the first centrifugal pump and the second centrifugal pump, wherein the transition chamber serves as a structural support for mounting the second centrifugal pump above and in vertical relation to the first centrifugal pump such that a portion of the weight of the second straight centrifugal pump is transferred to the first centrifugal pump, wherein a vertical center axis of the transition chamber is perpendicular to the first and second impeller shafts, and wherein the first and second impeller shafts are substantially parallel to each other along their respective longitudinal axes.

30. A pump arrangement in accord with claim 29, wherein the second centrifugal pump is cantilevered from the transition chamber.

31. A pump arrangement in accord with claim 29, wherein the first centrifugal pump comprises a first removable cover and wear plate assembly and wherein the second straight centrifugal pump comprises a second removable cover and wear plate assembly.

32. A pump arrangement in accord with claim 31, wherein said first and said second removable cover and wear plate assembly are substantially identical.

33. A stacked pump arrangement for mixed-media flow comprising:

a first centrifugal pump adapted to pump a mixed-media flow, which is self-priming, comprising a first impeller shaft and a volute having an inlet and an outlet; and a second straight centrifugal pump adapted to pump the mixed-media flow mounted to an upper portion of the first centrifugal pump, the second straight centrifugal pump comprising a volute with an inlet and an outlet, and a second impeller shaft; and a transition chamber connected, at one end, to the first centrifugal pump volute outlet and connected, at another end, to the second straight centrifugal pump volute inlet, the transition chamber serving as a structural support for mounting the second straight centrifugal pump above and in vertical relation to the first centrifugal pump such that a portion of the weight of the second straight centrifugal pump is transferred to the first centrifugal pump, wherein the stacked pump arrangement has a footprint equal to a footprint of the first centrifugal pump, and wherein the first and second impeller shafts are substantially parallel to each other along their respective longitudinal axes.

* * * * *